US007744402B2

(12) United States Patent
Wu

(10) Patent No.: US 7,744,402 B2
(45) Date of Patent: Jun. 29, 2010

(54) CABLE CONDUCTOR ASSEMBLY WITH PROTECTIVE STIFFENER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/891,803

(22) Filed: Aug. 13, 2007

(65) Prior Publication Data

US 2009/0047825 A1 Feb. 19, 2009

(51) Int. Cl.
*H01R 13/58* (2006.01)

(52) U.S. Cl. ..... 439/455; 439/470

(58) Field of Classification Search ..... 439/578, 439/497, 352–354, 610, 455, 459, 465, 469, 439/470, 472, 607.47–607.49, 460
See application file for complete search history.

(56) References Cited

U.S. PATENT DOCUMENTS 4,615,578 A * 10/1986 Stadler et al. ..... 439/607
4,981,447 A * 1/1991 Ichitsubo ..... 439/607
5,725,395 A * 3/1998 Lee ..... 439/610
5,934,942 A * 8/1999 Patel et al. ..... 439/610
6,257,914 B1 * 7/2001 Comerci et al. ..... 439/357
6,257,920 B1 * 7/2001 Finona et al. ..... 439/455
6,468,110 B2 * 10/2002 Fujino et al. ..... 439/610
6,793,520 B1 9/2004 Wu
6,817,898 B2 * 11/2004 Tanaka et al. ..... 439/579
6,823,587 B2 * 11/2004 Reed ..... 29/858
6,860,749 B1 * 3/2005 Wu ..... 439/352
6,951,477 B2 10/2005 Tondreault et al.

* cited by examiner

*Primary Examiner*—Xuong M Chung-Trans
(74) *Attorney, Agent, or Firm*—Wei Te Chung; Andrew C. Cheng; Ming Chieh Chang

(57) ABSTRACT

A cable connector assembly (100) includes an insulative housing (2) including a front mating portion and an opposite rear end, and a pair of wing portions (29) extending along a front-to-rear direction from the rear end to form a terminating area therebetween, a number of contacts (3) received in the insulative housing with tail portions (32) exposed beyond the rear end of the insulative housing and in the terminating area, a cable (4) including a number of conductors (40, 42) electrically connecting with corresponding tail portions of the contacts in the terminating area to form a number of terminations and an outer jacket enclosing the conductors, a stiffener (8) defining a receiving cavity receiving the outer jacket of the cable and assembled between the pair of wing portions of the insulative housing to locate in the terminating area, and a cover (5) enclosing the rear end of the insulative housing, the terminations between the cable and the contacts, and the stiffener.

1 Claim, 7 Drawing Sheets

CABLE CONDUCTOR ASSEMBLY WITH PROTECTIVE STIFFENER

BACKGROUND OF THE INVENTION

1. Field of the Invention

The present invention relates to a cable connector assembly, and particularly to a cable connector assembly used for high-speed transmission with low-profile.

2. Description of Related Art

There exists in the art an electrical connector known as a Serial Advanced Technology Attachment (Serial ATA) connector which is generally used for disk drives and storage peripherals. Especially, the Serial ATA connectors according to the Serial ATA standard are featured in fewer electrical contacts than other conventional electrical connectors and are relatively tiny in configuration. Further, for in accordance with current miniature trend, Serial ATA connectors are improved as low profile type. Therefore, the dimensions including height, width, length and thickness are decreased. Usually, such a Serial ATA cable connector assembly comprises an insulative housing retaining a plurality of contacts therein, a spacer assembled to the housing and the contacts, a cable electrically connecting with tail portions of the contacts, and a cover enclosing junctions between the cable and the contacts, rear end of the insulative housing, and the spacer via over-mold manner. However, with the decrease in dimensions of all elements, the thickness of the cover which protects the electrical connection between the cable and the contacts and protects the cable from being pulled to be separated from the contacts is not thick enough to realize functions above.

Thus, an additional protective member is needed. U.S. Pat. Nos. 6,951,477 and 6,793,520 disclose such additional protective members. U.S. Pat. No. 6,951,477 adapts a carrier connecting with grounding contacts and bounding the outer periphery of the cable with grounding conductors soldered with the grounding contacts and signal contacts electrically connecting with signal conductors of the cable via IDC means. However, to achieve the electrical connection between the cable and the contacts, IDC and solder technologies are adapted at the same time which is complex to operate and time consuming. U.S. Pat. No. 6,793,520 discloses a cable clamp comprising a first cable clamper and a second cable clamper assembled to the outer periphery of a cable and assembled together via some latch means formed thereon. However, the first and second cable clampers have different structures from each other which increase manufacture difficulty and are relatively costly. In addition, there is no positioning means to indicate the assembly of the cable to the housing and contacts, and this is not helpful to industry atomization.

Hence, a cable connector assembly having an improved protective stiffener is desired.

SUMMARY OF THE INVENTION

An object of the present invention is to provide a cable connector assembly of low-profile and having a protective stiffener to protect the reliable connection between contacts and cable.

To achieve the above object, a cable connector assembly in accordance with the present invention comprises an insulative housing comprising a front mating portion and an opposite rear end, and a pair of wing portions extending along a front-to-rear direction from the rear end to form a terminating area therebetween, a plurality of contacts received in the insulative housing with tail portions exposed beyond the rear end of the insulative housing and in the terminating area, a cable comprising a plurality of conductors electrically connecting with corresponding tail portions of the contacts in the terminating area to form a plurality of terminations and an outer jacket enclosing the conductors, a stiffener defining a receiving cavity receiving the outer jacket of the cable and assembled between the pair of wing portions of the insulative housing to locate in the terminating area, and a cover enclosing the rear end of the insulative housing, the terminations between the cable and the contacts, and the stiffener.

Other objects, advantages and novel features of the invention will become more apparent from the following detailed description when taken in conjunction with the accompanying drawings.

DETAILED DESCRIPTION OF THE INVENTION

Figure 1:
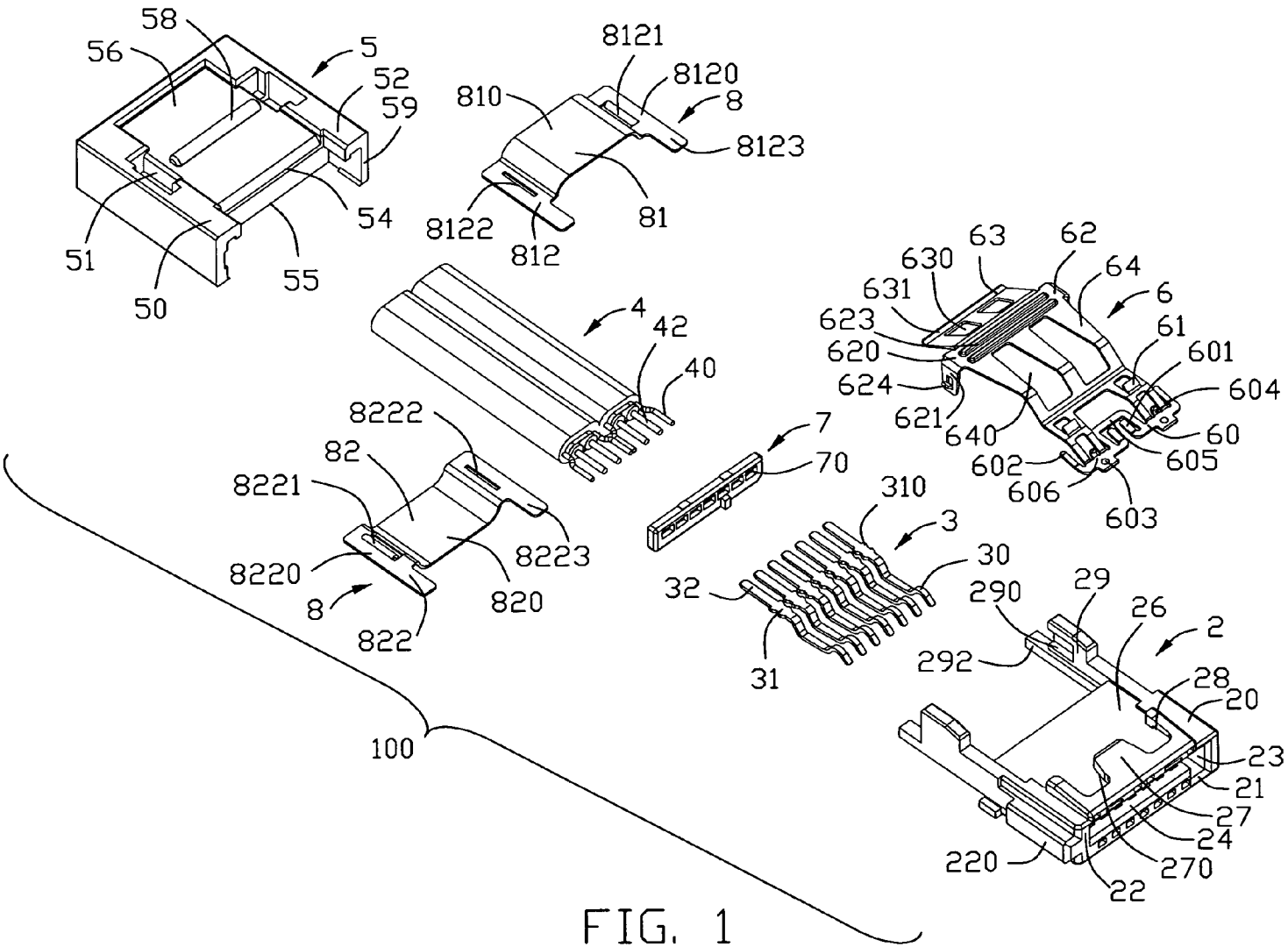
FIG. 1 is an exploded, perspective view of a cable connector assembly in accordance with the present invention.
Figure 2:
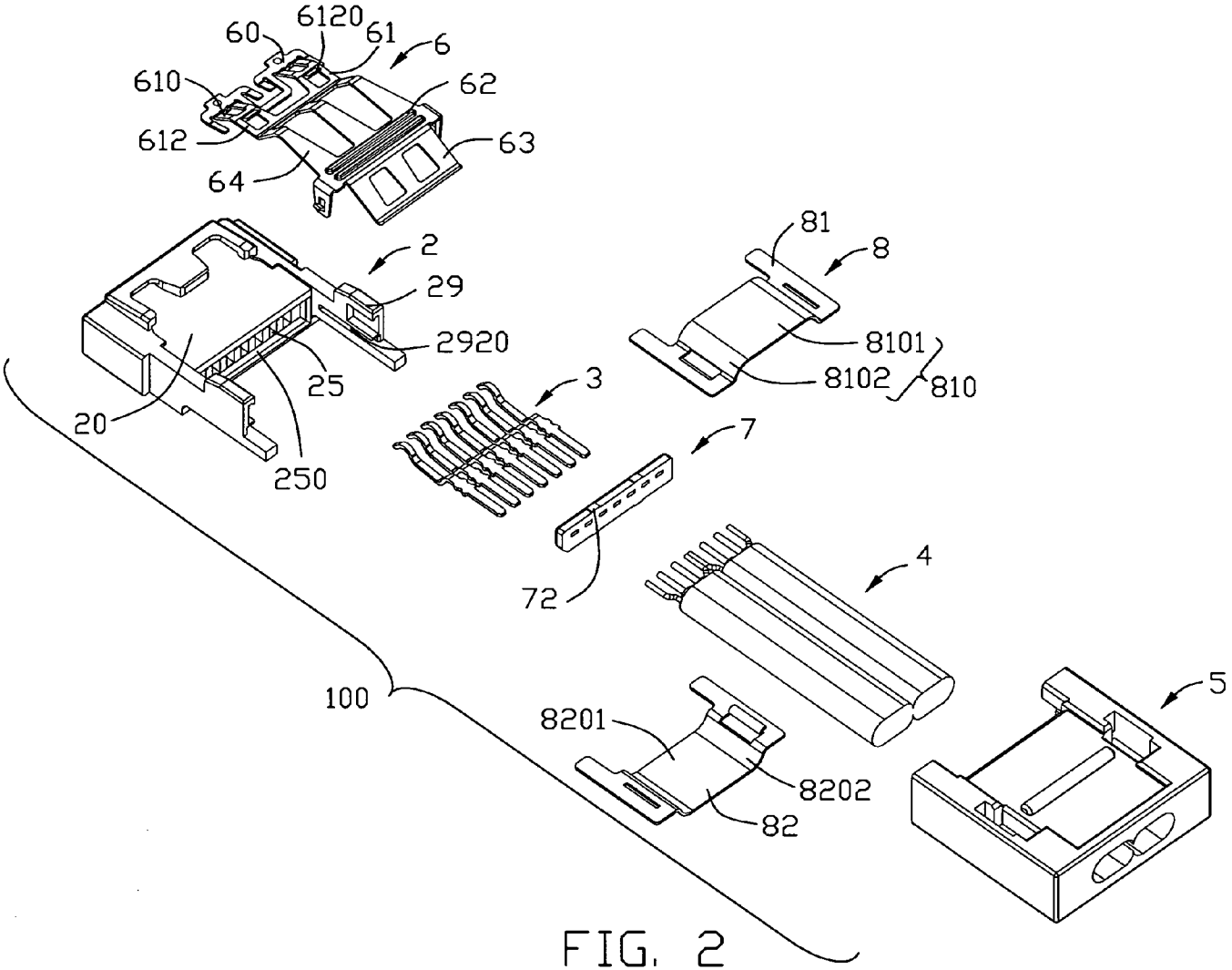
FIG. 2 is a view similar to FIG. 1, but taken from a different aspect.

Referring to FIGS. 1 and 2, a cable connector assembly 100 in accordance with the present invention is of low-profile and comprises an insulative housing 2, a plurality of contacts 3 housed in the insulative housing 2, a spacer 7 assembled to the insulative housing 2 and the contacts 3, a cable 4 electrically connecting with the contacts 2, a cover 5 enclosing the terminations between the contacts 3 and the cable 4, a locking member 6 assembled to the insulative housing 2 and the cover 5, and a metal stiffener 8 assembled to the housing 2 and the cable 4.

Referring to FIGS. 1-2, the insulative housing 2 comprises an upper wall 20, a lower wall 21 opposite to the upper wall 20, and a pair of sidewalls 22 connecting with the upper wall 20 and the lower wall 21. An L-shaped receiving space 23 is defined between the upper and the lower walls 20, 21. A block 24 is formed on the lower wall 21 and protrudes into the receiving space 23 to form the L-shape of the receiving space 23. The block 24 defines a plurality of passageways 25 extending therethrough. The upper wall 20 defines a depression 26 on an upper surface thereof. An M-shape extrusion portion 27 extends rearwardly from a front flange of the upper wall 20 into the depression 26. A middle slit 270 (FIG. 1 and FIG. 6) and a pair of side grooves 28 are respectively formed between the extrusion portion 27 and a bottom surface of the depression 26. A pair of first slots 272 and a pair of second slots 274 extend rearwardly from a front face of the upper wall 20 into the extrusion portion 27 and communicate with the slit 270, respectively. A pair of wing portions 29 respectively extend rearwardly from the sidewalls 22. Each wing portion 29 defines a cutout 290 in a rear portion thereof. A guiding portion 292 shaped as a bar is formed below corresponding wing portion 29 and longer than the wing portion 29. A guiding slit 2920 is thus formed between the guiding portion 292 and the wing portion 29. In addition, a recess 250 is recessed forwardly from a rear surface of the insulative housing 2 to communicate with the passageways 25. A guiding post 220 is formed with one sidewall 22 for polarization function. The insulative housing 2 further comprises a front end served as mating portion and an opposite rear end. The pair of wing portions 29 extends rearwardly from rear end to form a terminating area therebetween.

Each contact 3 comprises a curved contacting portion 30, a middle retention portion 31 rearwardly extending from the contacting portion 30, and a flat tail portion 32 rearwardly extending from the retention portion 31. Each lateral side of the retention portion 31 forms a pair of barbs 310 for interferentially engaging with the passageways 25 of the housing 2 to retain the contacts 3 in the housing 2.

The spacer 7 is interferentially received in the recess 250 of the insulative housing 2 via protrusions 72 on outer periphery thereof and defines a plurality of through holes 70 for allowing the tail portions 32 of the contacts 3 extending therethrough. The spacer 7 can prevent plastic from entering into the passageways 25 of the insulative housing 2 during the molding of the cover 5. The contacts 3 and the spacer 7 can be integrally formed before mounting to the insulative housing 2, if desired.

The stiffener 8 comprises an upper half 81 and a lower half 82 both made from metal material. The upper half 81 comprises an enclosing section 810 corresponding to the outer periphery of the cable 4 and a pair of side sections 812 connecting with the enclosing section 810 and lower than the enclosing section 810. Each side section 812 is located in a horizontal plane and comprises a rear main section 8120 and a front guiding section 8123 extending beyond front edge of the enclosing section 810. The enclosing section 810 comprises a higher flat section 8101 and a pair of arc sections 8102 connecting with opposite sides of the flat section 8101 and the pair of side sections 812. One side section 812 defines a slit 8122 in the main section 8120 and extending along front-to-back direction and the other side section 812 forms a latch tab 8121 bending downwardly from the main section 8120 and curved toward outside to form a hook shape. The lower half 82 has the substantially same structure as that of the upper half 81, but the lower half 82 curved downwardly. The lower half 82 also comprises an enclosing section 820 and a pair of side sections 822 higher than the enclosing section 820. The enclosing section 820 also comprises a lower flat section 8201 and a pair of arc sections 8202 curved upwardly to connect opposite sides of the flat section 8201 and the pair of side sections 822. Each side section 822 comprises a rear main section connecting with the arc section 8202 and a front guide section 8223 extending beyond the enclosing section 820. One side section 822 forms a latch tab 8221 bending upwardly from the main section 8220 and curved outwardly corresponding to the slit 8121 of the upper half 81. The other side section 822 defines a slit 8222 corresponding to the latch tab 8121 of the upper half 81. When the upper half 81 and the lower half 82 are assembled together, the latch tab 8121 protrudes through the slit 8222, and the latch tab 8221 protrudes through the slit 8122 to latch the upper and lower halves 81, 82, and the enclosing sections 810, 820 together define a receiving cavity to receive the cable 4 therebetween. That is, the stiffener 8 comprises an enclosing portion formed by the enclosing sections 810, 820 and defining the receiving cavity and a pair of side portions formed by the interferentially engaged side sections 812, 822 of the upper and lower halves 81, 82.

The cable 4 is in accordance with standard Serial ATA specification and has an eye-shaped cross section. The cable 4 comprises a pair of groups with an outer jacket enclosing the groups. Each group comprises a differential signal pair 42 and a pair of grounding conductors 40 arranged at opposite sides of the differential pair 42.

The cover 5 is over-molded with junctions between the cable 4 and the tail portions 32 of the contacts 3 and the rear end of the insulative housing 2. The cover 5 comprises a rectangular body portion 50 comprising an upper plate 52, a lower plate 53 opposite to the upper plate 52, and a pair of side plates 59 connecting with the upper plate 52, the lower plate 53. A receiving cavity 54 is formed between the upper and lower plates 52, 53. The pair of side plates 59 and side portions of the upper plate 52 are longer than the lower plate 53 and other portion of the upper plate 52 to form a cutout 55 to receive the rear end of the insulative housing 2 and communicating with the receiving cavity 54. The upper plate 52 defines a pair of passages 51 in a rear end thereof communicating with the receiving cavity 54. Each passage 51 has a relatively smaller size in a front portion and a relatively bigger size in a rear portion. The upper plate 52 defines a depression 56 adjacent to a rear edge thereof and a pivot portion 58 is formed between the pair of passages 51 in a lateral direction of the cover 5.

The locking member 6 is stamped and formed from a metallic plate and comprises a forward retaining portion 60, a locking portion 61 extending upwardly and rearwardly from the retaining portion 60, an elastic adjusting portion 64 extending rearwardly from the locking portion 61 and firstly upwardly then flatly, a flat pressing portion 62 extending rearwardly from the elastic adjusting portion 64, and a supporting portion 63 extending rearwardly and downwardly from the pressing portion 62. The retaining portion 60 consists of a pair of groups connecting by a U-shape connecting section 605 opening toward forwardly. Each group comprises a transverse bar 606, a bar section 602 extending rearwardly from outermost edge of the transverse bar 606, a snap section 601 extending upwardly and rearwardly from an innermost edge of the transverse bar 606 and a positioning section 603 extending forwardly from the middle of the transverse bar 606. The pair of snap sections 601 are located in the U-shape connecting section 605. A pair of stop sections 604 respectively bends upwardly from rear middle edge of the transverse bar 606 for preventing the locking member 6 is inserted into the insulative housing 2 excessively. The locking portion 61 is substantially L-shaped and comprises a pair of lower hollow connecting sections 610 connecting with rear edges of the pair of groups of the retaining portion 60 with the pair of stop sections 604 extending into the hollow spaces thereof and the pair of bar sections 602 located at outer sides thereof, and a pair of hollow locking sections 612 with a pair of latch sections 6120 extending upwardly and rearwardly from a front portion into the hollow spaces thereof. The pushing portion 62 comprises a body section 620 and a pair of side beams 621 at rear portion thereof and extending downwardly from opposite lateral ends of the body section 620. Each side beam 621 is stamped with a spring tab 624 extending outwardly therefrom. The body section 620 is formed with a plurality of ribs 623 at the rear portion for facilitating handling. The elastic adjusting portion 64 is of L-shape and defines a pair of irregular-shape first openings 640 for adjusting elastic force of the locking member 6. The supporting portion 63 also defines a pair of second openings 630 and forms a curved edge 631 at a free end thereof. The first and the second openings 640, 630 are defined for perfect deformation of the locking portion 61 and the supporting portion 63.

Referring to FIGS. 1-7, in assembly, the contacts 3 are firstly assembled to the insulative housing 2 as described above, then the spacer 7 is assembled to be received in the recess 250 of the insulative housing 2 with the tail portions 32 of the contacts 3 protruding through the through holes 70, and the spacer 7 is reliably received in the recess 250 via protrusions 72 thereof.

Figure 3:
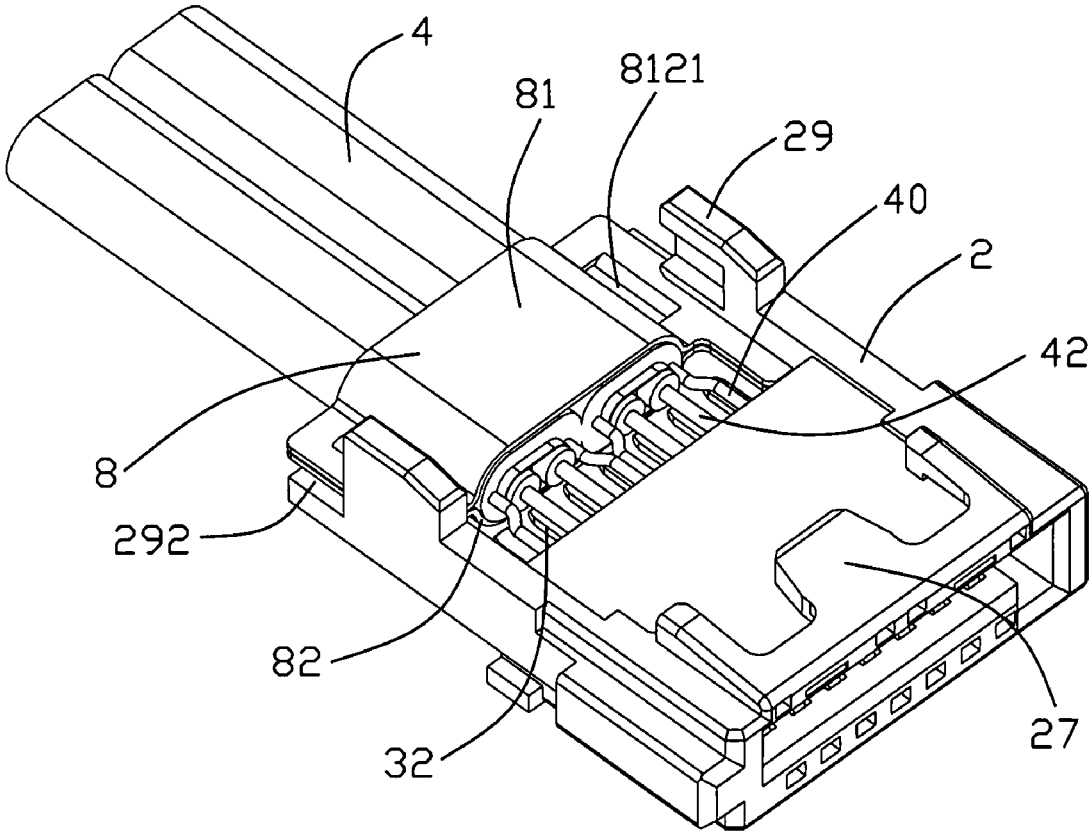
FIGS. 3-4 are partially assembled views of FIGS. 1-2.
Figure 4:
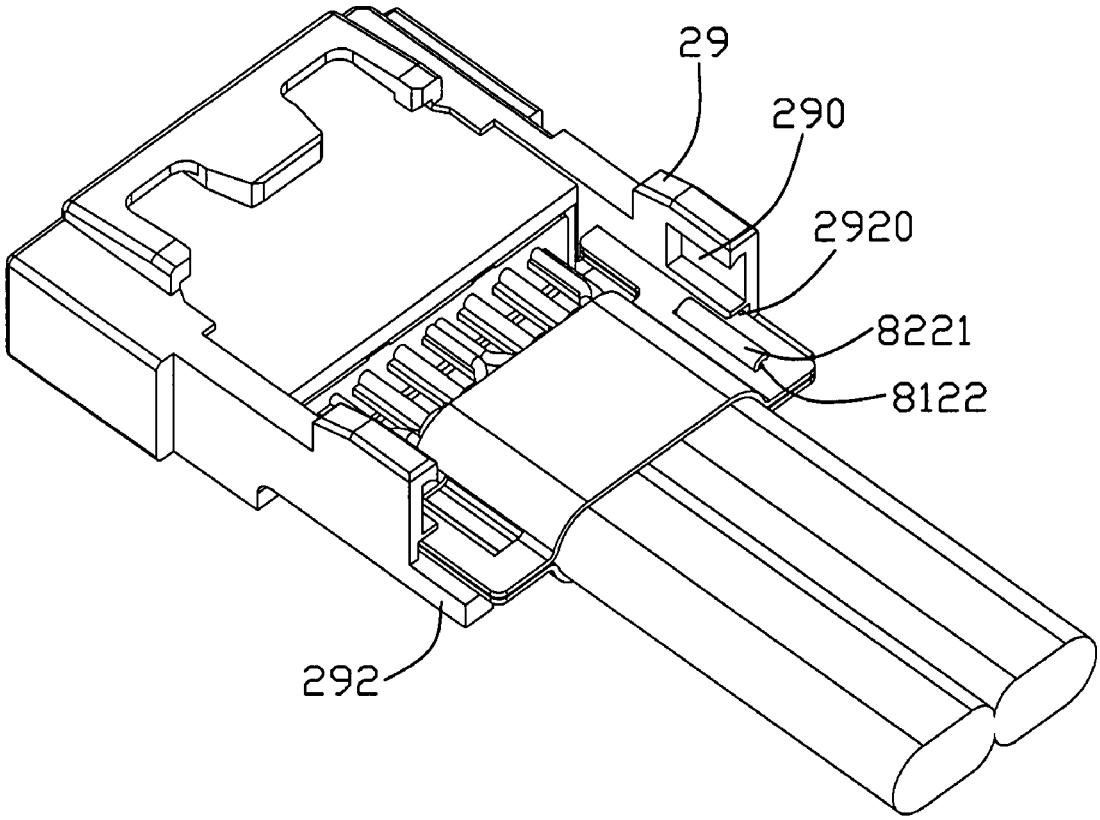
Figure 7:
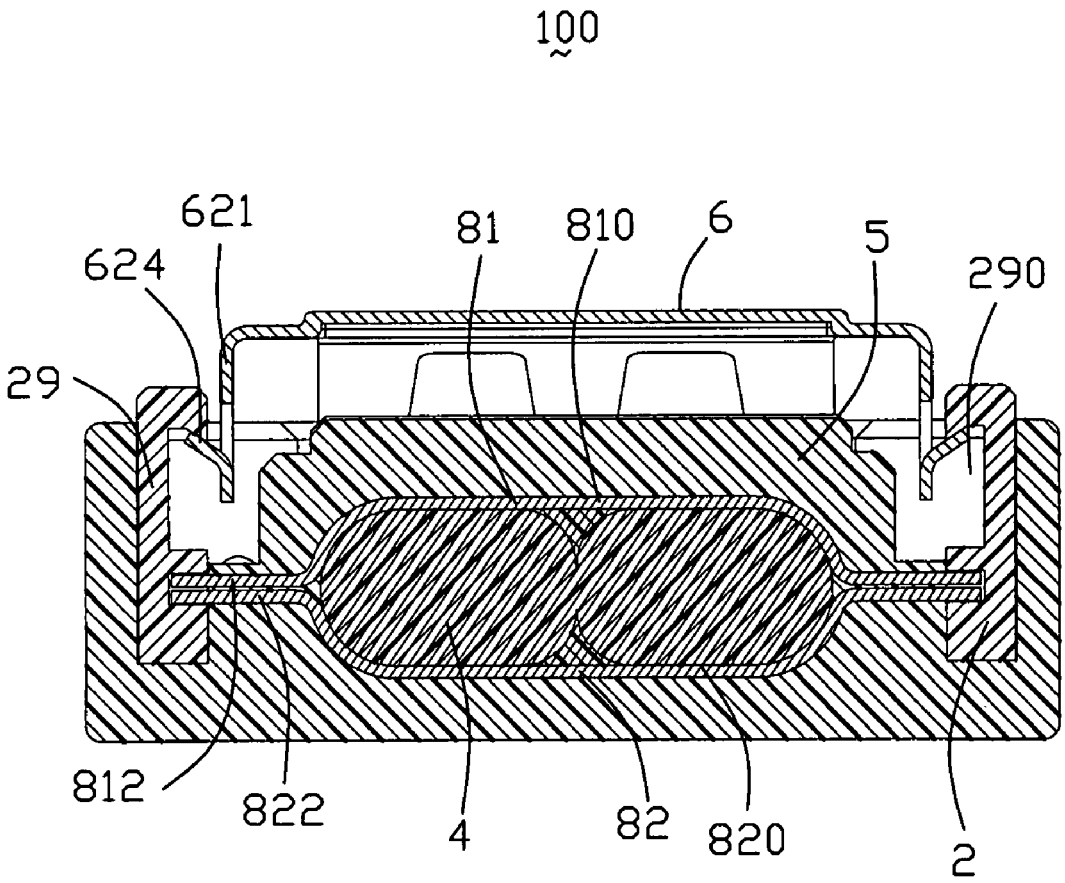

Particularly referring to FIGS. 3-4 and 7, the upper and lower halves 81, 82 are assembled to the cable 4 and then assembled to the insulative housing 2 and the contacts 3 together. The outer jacket of the cable 4 is received in the receiving cavity formed between the upper and lower halves 81, 82 with the upper and lower halves 81, 82 assembled to each other as described above. The forward conductors 40, 42 are exposed beyond the forward end of the outer jacket and the stiffener 8. The outer jacket of the cable 4 is tightly enclosed by the enclosing sections 810, 820 of the stiffener 8. Then, with the guidance of the guide sections 8123, 8223 sliding along the guiding slits 2920 of the insulative housing 2 until front ends of the guide sections 8123, 8223 abutting against rear surface of the insulative housing 2, the stiffener 8 and the cable 4 are assembled to the insulative housing 2 with the conductors 40, 42 aligning with corresponding contacts 3. The side sections 812, 822 are supported by the guiding portions 292 and sandwiched/positioned in the guiding slits 2920. The signal pairs 42 and the grounding conductors 40 of the cable 4 are soldered to the tail portions 32 of the contacts 3 which are exposed between the pair of wing portions 29.

The cover 5 is over-molded with the rear end of the insulative housing 2, the junctions between the contacts 3 and the cable 4, the stiffener 8 and the part of the cable 4 enclosed by the stiffener 8. The wing portions 129 are over-molded by the cover 5 and partially exposed beyond the passages 51. The wing portion 29 abuts against a front edge of the passage 51 for preventing the wing portion 29 from escaping the passage 51. The cable 4 is existed from rear end of the cover 5.

Figure 5:
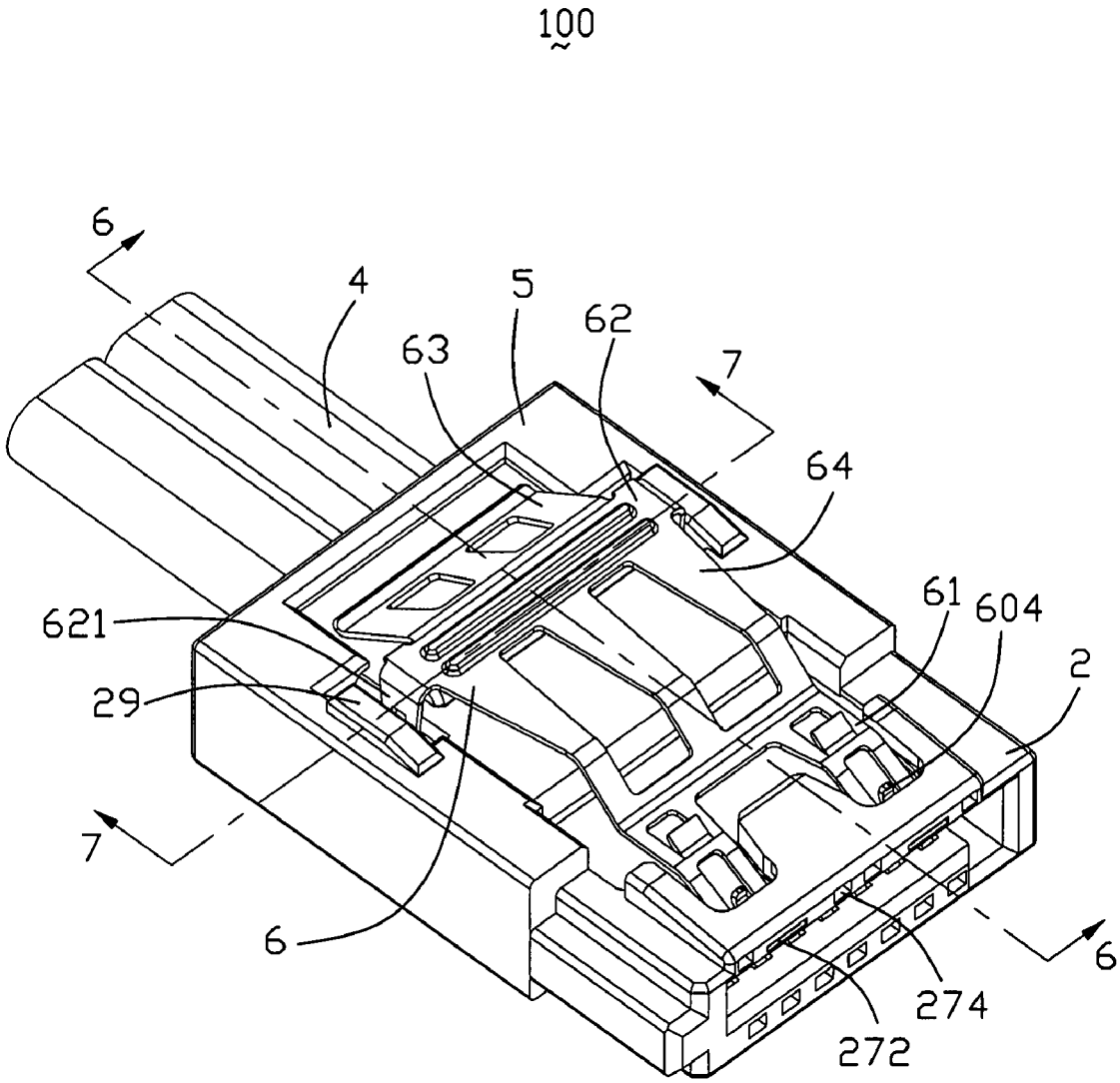
FIG. 5 is an assembled view of FIG. 1.
Figure 6:
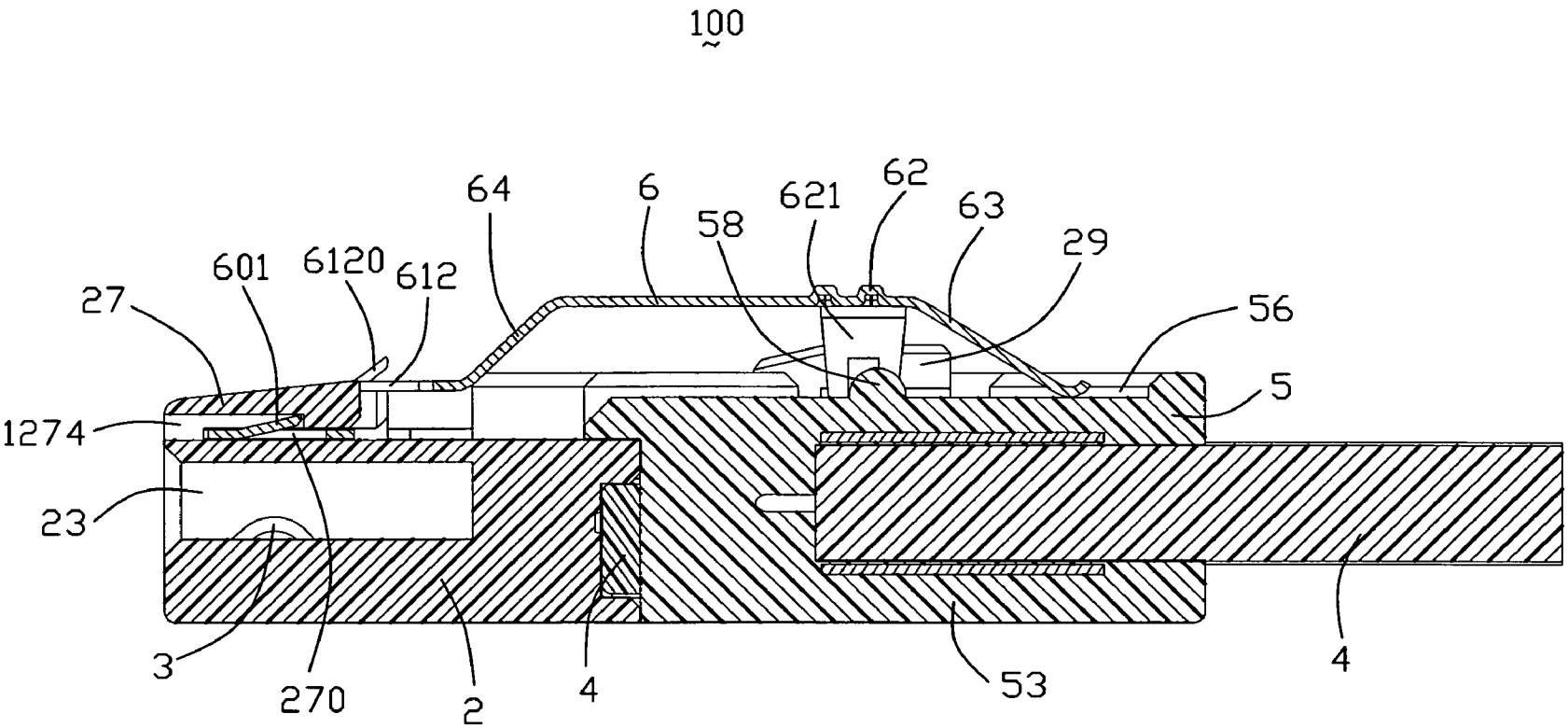
FIGS. 6-7 are cross-sectional views taken along lines 6-6 and 7-7 of FIG. 5.

Referring to FIGS. 5-7 in conjunction with FIGS. 1-2, the locking member 6 is assembled to the insulative housing 2 and the cover 5. Firstly, a forward pressing force is exerted on the locking member 6. The pair of side beams 621 of the locking member 6 are partially inserted into the rear portions of the passages 51 and pushed adjacent to wing portions 29 of the insulative housing 2, respectively. The pair of groups of the retaining portion 60 are respectively pushed to be partially received in the slit 270 and the grooves 28 of the insulative housing 2. Then, a downward and a forward pressing force are exerted on the pressing portion 62 of the locking member 6 in turn. The spring tabs 624 of the pressing portion 62 are pressed into the cutouts 290 of the wing portions 29 and slide along the cutouts 290. The bar sections 602 are received in the grooves 128 of the insulative housing 12. The transverse bars 606 of the retaining portion 60 is received in the slit 270 with the positioning sections 603 and the snap sections 601 respectively locked with the first and the second slots 272, 274 to prevent the locking member 6 from moving rearwardly when the cable connector assembly 100 mates with a complementary connector (not shown). The pair of stop sections 604 are exposed freely. The supporting portion 63 is located in the depression 56 of the cover 5 with the curved edge 631 abuts against a bottom surface of the depression 56. The spring tabs 624 of the pressing portion 62 elastically engage with inner surfaces of the cutouts 290 for preventing the locking member 6 from escaping the cutouts 290 of the housing 2. The pressing portion 62 is downwardly movable relative to the rear portion of the cover 5 to deflect the locking portion 61 toward the cover 5 and the insulative housing 2. The locking portion 61 and the elastic adjusting portion 64 are located above the housing 2 and the cover 5.

When the cable connector assembly 100 is to be mated with the complementary connector, a downward pressing force is exerted on the pressing portion 62 of the locking member 6. The pressing portion 62 moves downwardly until the rear portion of the body section 620 contacts with the pivot portion 58 of the cover 5 and the locking portion 61 creates a vertical displacement toward the housing 2. The body section 620 then becomes curve toward the cover 5 under the pressing force with the locking portion 61 creating a further vertical displacement. Since the retaining portion 60 and the supporting portion 63 respectively engage with the cover 5 and the insulative housing 2 and thus, together form a girder. The vertical displacement of the locking portion 61, particularly the latch sections 610, is big enough to realize the lock between the cable connector assembly 100 and the complementary connector easily. When the cable connector assembly 100 is to be disengaged from the complementary connector, a contrary operating procedure is applied. Because of the relatively big displacement of the latch sections 610, the disengagement between the cable connector assembly 100 and the complementary connector is also easy to realize.

In the preferred embodiment of the present invention, the cable connector assembly 100 is of low-profile and the cover 5 has a small thickness along vertical direction and hard to provide enough protection to the cable 4 and the termination between the cable 4 and the contacts 3. The stiffener 8 supports the cable 4 and is supported by the insulative housing 2 to aid the cover 5 to realize the function above.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly for mating with a complementary connector, comprising:

an insulative housing comprising a front mating portion and an opposite rear end, and a pair of wing portions extending along a front-to-rear direction from the rear end to form a terminating area therebetween, the pair of wing portions respectively defining a guiding slit therein;

a plurality of contacts received in the insulative housing with tail portions exposed beyond the rear end of the insulative housing and in the terminating area;

a cable comprising a plurality of conductors electrically connecting with corresponding tail portions of the contacts in the terminating area to form a plurality of terminations and an outer jacket enclosing the conductors;

a stiffener defining a receiving cavity receiving the outer jacket of the cable and assembled between the pair of wing portions of the insulative housing to locate in the terminating area; and a cover enclosing the rear end of the insulative housing, the terminations between the cable and the contacts, and the stiffener;

wherein the stiffener comprises an upper half and a lower half interferentially engaged with each other and together defining the receiving cavity to enclose the outer jacket of the cable therebetween;

wherein each of the upper half and the lower half forms an enclosing section and a pair of side sections at opposite sides of the enclosing section, and wherein the receiving cavity is formed by the enclosing sections of the upper and lower halves and corresponding to the outer periphery of the cable, and the side sections are interferentially attached to each other;

wherein the side sections of the upper half respectively forms a latch tab downwardly extending and a slit, the side sections of the lower half forms a slit and a latch tab, and wherein the latch tabs of the upper and lower halves respectively latch into the slits of the lower and upper halves; and the side section of the stiffener sandwiched in the guiding slit of the corresponding wing portion; wherein each side section forms a forward guide section extending beyond the enclosing section to slide along the guiding slit to guide the insertion of the stiffener.

* * * * *